US006889582B2

(12) United States Patent
Wilhelm

(10) Patent No.: US 6,889,582 B2
(45) Date of Patent: May 10, 2005

(54) COUPLING DEVICE FOR LOCKING PUSH-ON COUPLINGS OF TOOLS

(75) Inventor: Joachim Wilhelm, Wuppertal (DE)

(73) Assignee: Eduard Wille GmbH & Co KG, Wuppertal (DE)

( * ) Notice: Subject to any disclaimer, the term of this patent is extended or adjusted under 35 U.S.C. 154(b) by 0 days.

(21) Appl. No.: 10/458,904

(22) Filed: Jun. 11, 2003

(65) Prior Publication Data

US 2004/0007102 A1 Jan. 15, 2004

(30) Foreign Application Priority Data

Jun. 12, 2002 (DE) ..... 202 09 159 U

(51) Int. Cl.[7] ..... B25B 23/16

(52) U.S. Cl. ..... 81/177.85; 81/177.2; 403/322.2; 403/325

(58) Field of Search ..... 81/177.85, 177.2, 81/177.9; 403/321, 322.1, 322.2, 324, 325, 328

(56) References Cited

U.S. PATENT DOCUMENTS

| | | | | | |
|---|---|---|---|---|---|
| 4,367,663 | A | * | 1/1983 | Merics | 81/177.2 |
| 4,614,457 | A | * | 9/1986 | Sammon | 403/322.2 |
| 4,781,085 | A | * | 11/1988 | Fox, III | 81/177.85 |
| 4,962,682 | A | * | 10/1990 | Rose et al. | 81/177.85 |
| 5,390,571 | A | * | 2/1995 | Fox, III et al. | 81/177.85 |
| 5,660,491 | A | * | 8/1997 | Roberts et al. | 403/74 |
| 5,813,296 | A | * | 9/1998 | Hoff et al. | 81/177.85 |
| 6,003,414 | A | * | 12/1999 | Hsieh | 81/177.85 |
| 6,006,632 | A | * | 12/1999 | Hsieh | 81/177.85 |
| 6,062,112 | A | * | 5/2000 | Bonniot | 81/177.85 |
| 6,672,183 | B2 | * | 1/2004 | Johnson | 81/466 |

FOREIGN PATENT DOCUMENTS

| | | |
|---|---|---|
| DE | 297 58 493 C2 | 1/2000 |
| DE | 197 44 865 C2 | 5/2000 |
| DE | 201 19 262 U1 | 3/2002 |
| EP | 0 861 140 B1 | 11/1996 |
| EP | 0 747 174 B1 | 3/1997 |

* cited by examiner

*Primary Examiner*—David B. Thomas
(74) *Attorney, Agent, or Firm*—Mallinckrodt & Mallinckrodt

(57) ABSTRACT

A coupling device includes a polygonal coupling part on one of the parts to be coupled for engaging a complementary polygonal counterpart on another of the parts to be coupled. The polygonal coupling part has outer side faces, a longitudinal bore therein, and a first transverse bore with a ball therein intersecting the longitudinal bore and one of the side faces. An actuating body tapering at first and second ends is guided for longitudinal movement in the longitudinal bore between an extended position wherein the first end moves the ball radially into a locking position and a retracted position permitting inward movement of the ball out of its locking position. A second transverse bore intersecting the longitudinal bore guides a releasing element having a cam surface engaging the second end of the actuating body. The releasing element is movable against the action of a biasing spring to move the actuating body from its extended position to its retracted position.

18 Claims, 1 Drawing Sheet

COUPLING DEVICE FOR LOCKING PUSH-ON COUPLINGS OF TOOLS

TECHNICAL FIELD

The invention relates to a coupling device for locking push-on couplings especially of tools, the coupling device being releasable by actuating a releasing element to permit easy detaching of the push-on coupling. The push-on coupling comprises a polygonal coupling part on one of the parts to be coupled for engaging a complementary polygonal counterpart on another of the parts to be coupled. The polygonal part has a longitudinal passage or bore. The longitudinal bore communicates with a transverse bore intersecting the longitudinal bore and opening in a side face of the polygonal coupling part. A ball is guided in the transverse bore. An actuating body is longitudinally movable in the longitudinal bore. A tapering end of the actuating body engages the ball, whereby longitudinal movement of the actuating body in the longitudinal bore to an extended position causes the ball to move outwards into a locking position. Longitudinal movement of the actuating body into a retracted position is permitted by actuation of the releasing element against the action of return spring means.

BACKGROUND OF THE INVENTION

Parts of tools are often interconnected by push-on couplings by means of a polygonal coupling body on one part and a complementary counter-part on the other part of the tool. A typical example is the attaching of a socket matching the shape of the respective screw or nut, or the attaching of an extension bar to a ratchet. Other applications are the attaching of a sliding T-handle, an adaptor, a drive handle, a universal joint, a flexible handle, a speeder brace or a T-handle universal joint spanner. Mere push-on couplings are unsafe and can easily get loose. Therefore, coupling devices with locking balls are provided, which hold the parts of the push-on coupling, namely polygonal coupling part and complementary counter-part, together.

A tool, for example a ratchet, has a square, which is rotatable step-by-step through a ratchet mechanism by reciprocating a handle lever. A socket, i.e. a tool part having a shape matching the screw or nut to be rotated, is coupled with this ratchet. For adapting the tool to the respective screw or nut, this socket can be removed and can be replaced by a socket of the appropriate shape. The socket is locked by a locking ball. When the socket is to be removed, the locking ball can simply be pushed inwards by pulling the socket from the square. This may require considerable force, as also large and, thereby, heavy sockets have to be retained safely on the square. As the screw or nut often cannot be reached with the normal tool, extension bars or connecting tools such as universal joints or adaptors are required.

Push-on couplings with quick release are known. Usually, such push-on couplings have a spring-loaded ball on the square, the ball engaging a corresponding recess of a socket or the like pushed on the square and retaining the socket in axial direction. A release button is actuated for releasing the push-on coupling. Thereby, a mechanism is moved which permits the ball to be pushed into the square. Then the parts can be disconnected by easily pulling the socket from the tool.

DE 201 19 262 U1 shows such a push-on coupling with quick release. A polygonal coupling part is provided on a base body. The polygonal coupling part has a radial bore in one of its side faces. A ball is guided in the bore. A rod is guided in a longitudinal passage of the polygonal coupling part. The rod has a recess. The ball can partially be accommodated by the recess. Then, it is completely sunk into the polygonal coupling part. The rod is rotatable about its axis by a releasing element between two angular positions. In one of the angular positions, the ball is urged radially outwards, whereby interlocking of the two parts of the push-on coupling is caused. In the other angular position of the rod, the recess is aligned with the bore, whereby the ball can yield and does not impede the pulling the push-on coupling apart.

EP 0 747 174 B1 describes a push-on coupling for a socket extension bar. A slide is movably guided in a longitudinal passage of a polygonal coupling part. The longitudinal passage communicates with a transverse bore. A ball is guided in the transverse bore. The slide has a recess which, in one position of the slide, is adapted to accommodate the ball. A spring acts on the slide. The slide can be shifted by means of a knob guided in a further transverse bore, through an inclined surface and against the action of the spring, to a position, in which the ball is accommodated in the recess.

The prior art structures described above require complex parts and, therefore, can only be manufactured with considerable expenditure.

EP 0 861 140 B1 describes a quick release coupling device, wherein a slide is guided in a longitudinal bore of a polygonal coupling body, the slide being axially displaced by a pivotally mounted actuating knob against the action of a spring. The slide has a reduced-diameter section. This section, in one position of the slide permits accommodation of a ball which is guided in a transverse bore. Thereby, the locking is released. Also this arrangement is very expensive both with respect to the design and with respect to the manufacturing.

U.S. Pat. No. 4,962,682 discloses a releasable coupling device wherein a generally longitudinal passage contains a row of balls of which the last one is located in a radial section of this passage. The balls are supported on a spring-loaded release button, the last ball extending beyond the surface of the polygonal coupling body. By pushing the release button down, a circumferential groove of the release button gets into the range of the balls, so that the balls can yield axially and the last ball yields radially.

DE 197 44 865 relates to a tubular socket extension. The socket extension has a square at one end and a square recess at its other end. A rod extends centrally through the tubular socket extension and is guided in a longitudinal passage of the square. The rod has a tapering end within the longitudinal passage. A ball is guided in a transverse bore. This ball can be urged radially outwards for locking, for example, a socket, when the rod is moved in the direction towards the square. If a square, for example of a ratchet, is pushed into the square recess, the square presses on the end of the rod extending into the sqare recess and moves the rod against the action of the spring into a position in which the ball is urged radially outwards through the tapering end.

DE 197 58 493 C2 shows a socket extension rod with an actuating body, which is movably guided in a longitudinal bore of a polygonal coupling body. The actuating body is generally cylindrical with a conically tapering end within the longitudinal bore. A ball guided in a transverse bore can be urged radially outwards by the conical end of the actuating body. The other end of the actuating body is formed by a knob having a plane surface. A spring urges the actuating body away from the ball out of the polygonal coupling body. A cam mounted for rotation can press the actuating body forward against the action of the spring and, then, moves the ball through the conical end into a locking position.

DISCLOSURE OF THE INVENTION

It is an object of the invention, to construct a coupling device for locking a push-on coupling by means of easy to manufacture and, therefore, inexpensive components.

To this end, a coupling device of the type described in the beginning is designed as follows:

A polygonal coupling part, on one of the parts to be coupled, is provided for engaging a complementary polygonal counterpart on another of the parts to be coupled. Said polygonal coupling part has outer side faces. Said polygonal coupling part has a longitudinal bore therethrough and a first transverse bore intersecting said longitudinal bore and opening in one of said side faces. A ball is guided in said first transverse bore. An actuating body is guided for longitudinal movement in said longitudinal bore between an extended position and a retracted position. Said actuating body is generally cylindrical with a first end and a second end and tapering at said first and second ends. Said tapering first end engages said ball. Thereby said ball, upon longitudinal movement of said actuating body to said extended position, is moved in said first transverse bore radially outwardly into a locking position, in which the ball projects beyond said side face. A second transverse bore is provided in said one part to be coupled. Said second transverse bore intersects said longitudinal bore. Said releasing element is a body of revolution guided in said second transverse bore and having a cam surface of revolution. Said second end of said actuating body essentially engages said cam surface. Spring means engage said releasing element for urging said releasing element to a first position, in which said cam surface has moved said actuating body to its forward position. Said releasing element is movable against the action of said spring means from said first position to a second position, in which said actuating body is free to be moved to its retracted position to permit inward movement of said ball out of its locking position.

This provides a simple, in particular easy to manufacture and, therefore, inexpensive design, which can be realized substantially by turned parts and bores only. The actuating body is moved forward under the action of the spring means through the cam surface, so that the ball is moved into its locking position. For quick release of coupling, the releasing element is pushed down against the action of the spring. Then, the cam surface releases the actuating body, so that the actuating body yields upon exertion of radial force on the ball without resistance and permits radial yielding of the ball, also without substantial resistance. The contact surface between the actuating body and the ball is very little, exactly only a contact point. Furthermore the contact surface between the actuating body and the cam surface is very little as well, exactly only a contact line. Therefore the movements in all are easy-running. In this manner the construction is not susceptible to contamination.

Preferably said tapering second end of said actuating body has an end face normal to the direction of said longitudinal movement of said actuating body. Said cam surface has a first cylindrical section, which is engaged by said end face of said actuating body in said extended position.

Thereby, the actuating body, in its extended position in which the ball is in its locking position, is safely supported against axial forces, which might be exerted by the ball. The actuating body is in a well-defined position.

Advantageously, said cam surface has a second cylindrical section, the diameter of which is smaller than that of said first cylindrical section. Said end face of said actuating body engages said second cylindrical section in said retracted position. Then also the retracted position of the actuating body, in which it permits inward yielding of the ball, is exactly defined. Thereby, in said retracted position permitting said ball to yield, said ball is retained in said first transverse bore by said first end of said actuating body. The ball cannot be pressed into the longitudinal bore.

In a preferred embodiment, a conical section of said cam surface interconnects said cylindrical first and second sections. When the releasing element is pushed down, the end face of the actuating body slides off the cylindrical section. The actuating body slides along the conical section from its extended position to its retracted position, in which the end face engages the second cylindrical section. The ball is permitted to yield, and the locking is released. After the release element is freed, the actuating body is moved forward again to its extended position by the conical section of the cam surface under the action of the spring means acting on the releasing element. The end face of the actuating body, under the action of the spring means acting on the releasing element, again engages the first cylindrical section.

An embodiment of the invention is described hereinbelow with reference to the accompanying drawings.

DESCRIPTION OF PREFERRED EMBODIMENT OF THE INVENTION

Figure 1:
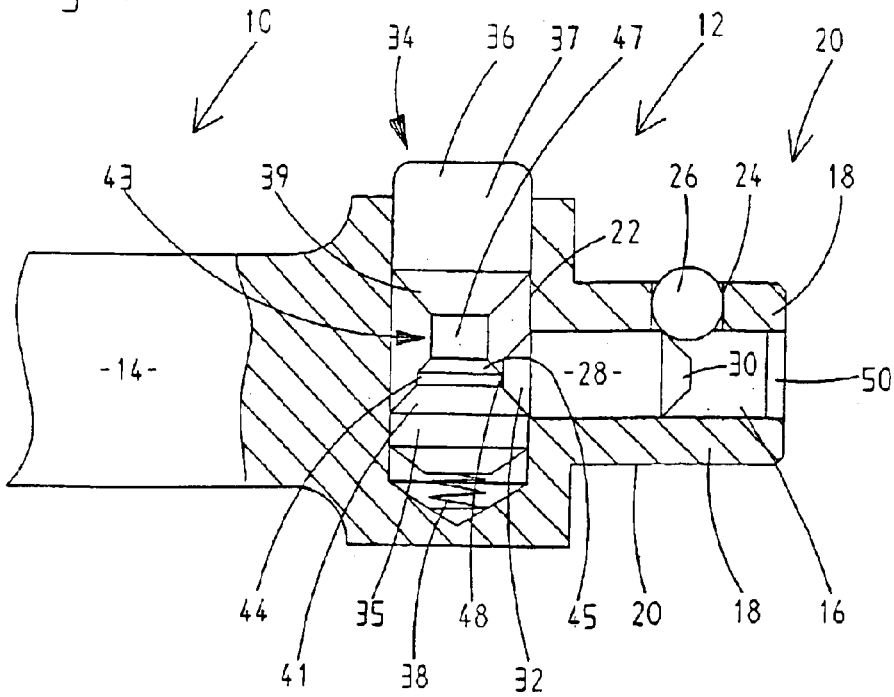
FIG. 1 is a sectional view of part of a coupling device of the invention in its locked state.

FIG. 1 illustrates, in sectional view, part of an actuating tool or connecting part, for example an extension rod 10 with quick release 12 for sockets. The extension rod 10 has a body 14. At one end of the body 14 is an axial, longitudinal passage 16 in the form of a bore. The axial longitudinal passage 16 is surrounded by side faces 18 of a polygonal coupling body 20. A transverse bore 22 in the form of a blind bore is provided normal to the axial longitudinal passage 16 and intersects this passage. A ball 26 is provided in a transverse bore 24 opening in a side face 18 of the polygonal coupling body 20. An actuating body 28 is guided in the longitudinal passage 16. The ball 26 can be either sunk into the polygonal coupling body 14 or caused to project therefrom depending on the position of the actuating body 28. Well-known means for limiting the outward movement of the ball 26 are provided at the transverse bore 24.

The actuating body 28 is conical at its ends 30, 32. Because of the conical shape of one end 30, the ball 26 can continuously be sunk into or lifted out of the polygonal coupling body, depending on the axial movements of the actuating body 28. The other conical end 32 of the actuating body 28 engages a dumbbell-shaped releasing element 34 made as a turned part.

The releasing element 34 is dumbbell-shaped, having two end portions 35 and 37 of generally cylindrical shape. The end portions have frustro-conical inner sections 39 and 41, respectively, facing each other. The end portions 35 and 37 are guided in the transverse bore 22. A cam surface 43 is formed between these end portions 35 and 37. This cam surface 43 consists of a cylindrical section 44 of relatively large diameter, a conical section 45 and a cylindrical section 47, the diameter of which is small relative to that of the section 44. The cone angle of the conical end 32 of the actuating body 28 is complementary to the cone angle of the conical section 45 of the cam surface 43. The releasing element 34 extends slightly out of the transverse bore 22 and forms a push-button 36. The releasing member 34 is biased by a spring 38. The spring 38 is arranged between the end portion 35 of the releasing element 34 and the ground of the transverse bore 22, which is a blind bore. The spring 38 urges the releasing element 34 upwards in the Figures into the position illustrated in FIG. 1. By pressing on the push-button 36 against the action of the spring 38, the releasing element can be displaced downwards into the position illustrated in FIG. 2.

The actuating body is generally cylindrical. The left end 32, as viewed in the Figures, of the actuating body 28 is frustro-conical and defines a plane end face 48 normal to the axis of the actuating body 28, namely the smaller face of the truncated cone. The right end 30, as viewed in the Figures, of the actuating body 28 is also frustro-conical.

In the position of FIG. 1, the releasing element 34 is pushed upwards by the spring 38. The plane end face 48 of the actuating body 28 engages the cylindrical section 44 of the cam surface 43 of the releasing element 34. The actuating body 28 is in its right end position or extended position, in which it pushes, through the frustro-conical end 30, the ball 26 in transverse bore 24 outwards into its locking position. In this state, the actuating body 28 assumes a well-defined position. It is not possible, to displace the actuating body 28 to the left in the Figures by pressing on the ball 26.

Figure 2:
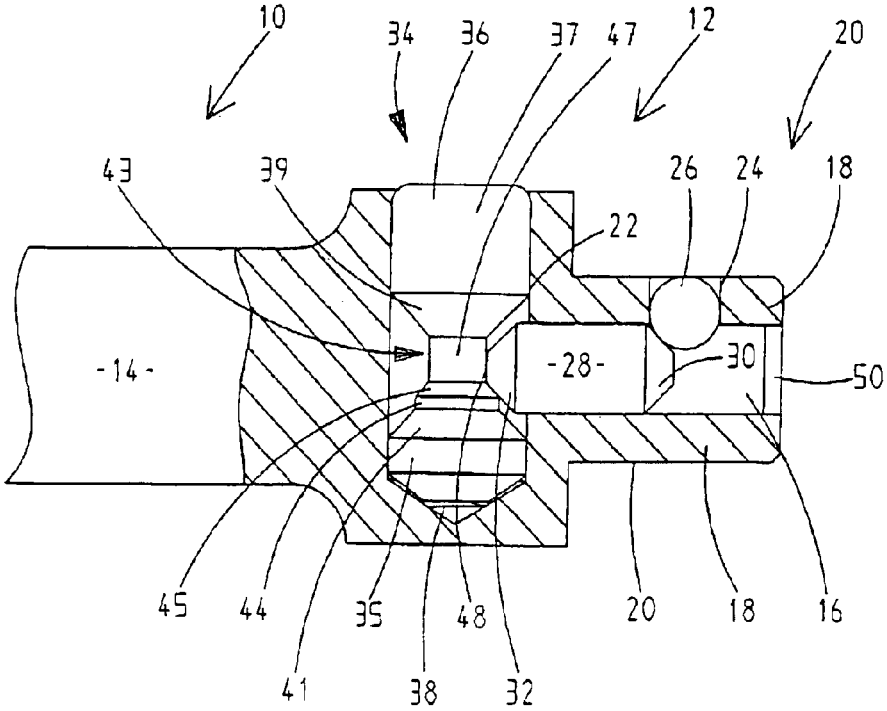
FIG. 2 is a sectional view similar to FIG. 1 but showing the coupling device in its released state.

When the releasing element 34 is pushed down, the end face 48 slides off the cylindrical section 44. Thereby, the actuating body 28 is released. The actuating body 28 is free to move to the left in the Figures along the conical section 45, until the actuating body 28 engages the smaller-diameter cylindrical section 47. In this retracted position of the actuating body 28, as illustrated in FIG. 2, the ball 26 can yield inwards into the transverse bore 24. Thereby, the locking is released. The part, for example a socket, mounted on the polygonal coupling body 20 can be pulled off without effort. Also the retracted position of the actuating body 28 in FIG. 2 is exactly defined by engagement of the end face 48 at the cylindrical section 47. In this position, the ball 26 is retained in the transverse bore 24 by the end 30 of the actuating body 28. The ball 26 cannot be pressed inwards into the longitudinal passage 16. Also here, it is not possible to displace the actuating body 28 further to the left by pressing on the ball 26.

The longitudinal passage 16 is closed at its end by a plug 50.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

I claim:

1. A coupling device for locking push-on couplings especially of tools, said coupling device being releasable by actuation of a releasing element to permit easy detaching of the push-on coupling, the push-on coupling comprising:

a polygonal coupling part, on one of the parts to be coupled, for engaging a complementary polygonal counterpart on another of the parts to be coupled, said polygonal coupling part having outer side faces, said polygonal coupling part having a longitudinal bore therethrough and a first transverse bore intersecting said longitudinal bore and opening in one of said side faces, a ball guided in said first transverse bore, an actuating body guided for longitudinal movement in said longitudinal bore between an extended position and a refracted position, said actuating body being generally cylindrical with a first end and a second end and tapering at said first and second ends, said tapering first end engaging said ball, whereby said ball, upon longitudinal movement of said actuating body to said extended position, is moved in said first transverse bore radially outwardly into a locking position, in which the ball projects beyond said side face, a second transverse bore in said one part to be coupled, said second transverse bore intersecting said longitudinal bore, said releasing element being a body of revolution guided in said second transverse bore and having a cam surface of revolution, said tapering second end of said actuating body having an end face normal to the direction of said longitudinal movement of said actuating body, said cam surface having a first cylindrical section, which is essentially engaged by said end face of said actuating body in said extended position, a second cylindrical section, the diameter of which is smaller than that of said first cylindrical section, said end face of said actuating body essentially engaging said second cylindrical section in said retracted position, and a conical section interconnecting said first and second cylindrical sections, spring means engaging said releasing element for urging said releasing element to a first position, in which said cam surface has moved said actuating body to its extended position, said releasing element being movable against the action of said spring means from said first position to a second position, in which said actuating body is free to be moved to its retracted position to permit inward movement of said ball out of its locking position.

2. A coupling device for locking push-on couplings especially of tools, said coupling device being releasable by actuation of a releasing element to permit easy detaching of the push-on coupling, the push-on coupling comprising:

a polygonal coupling part, on one of the parts to be coupled, for engaging a complementary polygonal counterpart on another of the parts to be coupled, said polygonal coupling part having outer side faces, said polygonal coupling part having a longitudinal bore therethrough and a first transverse bore intersecting said longitudinal bore and opening in one of said side faces, a ball guided in said first transverse bore, an actuating body guided for longitudinal movement in said longitudinal bore between an extended position and a retracted position, said actuating body being generally cylindrical with a first end and a second end and tapering at said first and second ends, said tapering first end engaging said ball, whereby said ball, upon longitudinal movement of said actuating body to said extended position, is moved in said first transverse bore radially outwardly into a locking position, in which the ball projects beyond said side face, a second transverse bore in said one part to be coupled, said second transverse bore intersecting said longitudinal bore, said releasing element being a body of revolution guided in said second transverse bore and having a cam surface of revolution, said tapering second end of said actuating body having a plane end face normal to the direction of said longitudinal movement of said actuating body, said cam surface having a first cylindrical section, which is essentially engaged by said end face of said actuating body in said extended position, spring means engaging said releasing element for urging said releasing element to a first position, in which said cam surface has moved said actuating body to its extended position, said releasing element being movable against the action of said spring means from said first position to a second position, in which said actuating body is free to be moved to its retracted position to permit inward movement of said ball out of its locking position.

3. A coupling device as claimed in claim 2, wherein said cam surface has a second cylindrical section, the diameter of which is smaller than that of said first cylindrical section, said end face of said actuating body essentially engaging said second cylindrical section in said retracted position.

4. A coupling device as claimed in claim 3, wherein, in said retracted position permitting said ball to yield, said ball is retained in said first transverse bore by said first end of said actuating body.

5. A coupling device as claimed in claim 4, wherein a conical section of said cam surface interconnects said cylindrical first and second sections.

6. A coupling device as claimed in claim 5, wherein said second end of said actuating body is frustro-conical to define said plane end face.

7. A coupling device as claimed in claim 6, wherein said frustro-conical end of said actuating body has a cone angle complementary to the cone angle of said conical section of said cam surface.

8. A coupling device as claimed in claim 7, wherein said releasing element is dumbbell-shaped having two generally cylindrical end portions with frustro-conical sections facing each other, said end portions being guided in said second transverse bore, said cam surface being formed between said frustro-conical sections.

9. A coupling device as claimed in claim 8, wherein said second transverse bore is a blind bore defining a bottom, said spring means being located between said bottom of said blind bore and said releasing element, said releasing element having an integral push-button, which, in said first position, projects from said one part to be coupled.

10. A coupling device as claimed in claim 2, wherein said first transverse bore has means for limiting outward movement of said ball.

11. A coupling as claimed in claim 2, and further comprising means for closing said longitudinal bore.

12. A coupling device for locking push-on couplings especially of tools, said coupling device being releasable by actuation of a releasing element to permit easy detaching of the push-on coupling, the push-on coupling comprising:

a polygonal coupling part, on one of the parts to be coupled, for engaging a complementary polygonal counterpart on another of the parts to be coupled, said polygonal coupling part having outer side faces, said polygonal coupling part having a longitudinal bore therethrough and a first transverse bore intersecting said longitudinal bore and opening in one of said side faces, a ball guided in said first transverse bore, an actuating body guided for longitudinal movement in said longitudinal bore between an extended position and a retracted position, said actuating body being generally cylindrical with a first end and a second end and tapering at said first and second ends, said tapering first end engaging said ball, whereby said ball, upon longitudinal movement of said actuating body to said extended position, is moved in said first transverse bore radially outwardly into a locking position in which the ball projects beyond said side face, and upon longitudinal movement to said retracted position, is permitted to yield radially inwardly into said first transverse bore, said ball being retained in said first transverse bore by said first end of said actuating body, a second transverse bore in said one part to be coupled, said second transverse bore intersecting said longitudinal bore, said releasing element being a body of revolution guided in said second transverse bore and having a cam surface of revolution, said tapering second end of said actuating body having an end face normal to the direction of said longitudinal movement of said actuating body, said cam surface having a first cylindrical section, which is essentially engaged by said end face of said actuating body in said extended position, a second cylindrical section, the diameter of which is smaller than that of said first cylindrical section, said end face of said actuating body essentially engaging said second cylindrical section in said retracted position, and a conical section interconnecting said first and second cylindrical sections, spring means engaging said releasing element for urging said releasing element to a first position, in which said cam surface has moved said actuating body to its extended position, said releasing element being movable against the action of said spring means from said first position to a second position, in which said actuating body is free to be moved to its retracted position to permit inward movement of said ball out of its locking position.

13. A coupling device as claimed in claim 12, wherein said second end of said actuating body is frustro-conical to define said plane end face.

14. A coupling device as claimed in claim 13, wherein said frustro-conical end of said actuating body has a cone angle complementary to the cone angle of said conical section of said cam surface.

15. A coupling device as claimed in claim 14, wherein said releasing element is dumbbell-shaped having two generally cylindrical end portions with frustro-conical sections facing each other, said end portions being guided in said second transverse bore, said cam surface being formed between said frustro-conical sections.

16. A coupling device as claimed in claim 15, wherein said second transverse bore is a blind bore defining a bottom, said spring means being located between said bottom of said blind bore and said releasing element, said releasing element having an integral push-button, which, in said first position, projects from said one part to be coupled.

17. A coupling device as claimed in claim 12, wherein said first transverse bore has means for limiting outward movement of said ball.

18. A coupling as claimed in claim 12, and further comprising means for closing said longitudinal bore.

* * * * *